US005584218A

United States Patent [19]

Schoendienst

[11] Patent Number: 5,584,218

[45] Date of Patent: Dec. 17, 1996

[54] CUTTER HAVING A PAIR OF COOPERATING FLEXIBLE BLADES PROVIDING A PAIR OF MOVING POINT CUTTING EDGES

[75] Inventor: Rudolph Schoendienst, Sea Girt, N.J.

[73] Assignee: Hecon Corporation, Eatontown, N.J.

[21] Appl. No.: 261,809

[22] Filed: Jun. 17, 1994

[51] Int. Cl.[6] ..... B26D 1/03; B26D 1/09

[52] U.S. Cl. ..... 83/636; 83/694; 83/695; 83/696

[58] Field of Search ..... 83/636, 637, 694, 83/696, 613, 679, 695, 697

[56] References Cited

U.S. PATENT DOCUMENTS

| | | | |
|---|---|---|---|
| 635,457 | 10/1899 | Yandall | 83/636 X |
| 1,326,460 | 12/1919 | Lorenz | 83/694 |
| 1,372,221 | 3/1921 | Dutro et al. | 83/384 |
| 1,798,106 | 3/1931 | Pels | 83/694 |
| 4,619,168 | 10/1986 | Klisch | 83/694 |
| 5,090,285 | 2/1992 | Kondô | 83/636 |
| 5,105,703 | 4/1992 | Kondô | 83/636 |

*Primary Examiner*—Rinaldi I. Rada
*Assistant Examiner*—Raymond D. Woods
*Attorney, Agent, or Firm*—Louis Weinstein

[57] ABSTRACT

A cutting device having blades with V-shaped cutting edges and shaped to cause the blade centers to deviate from a vertical plane. One blade is reciprocated. The outer ends of each blade have sliding projections engaging marginal portions of outer surfaces of the other blade so that the cutting edges are drawn toward and cross-over one another during cutting, whereby the blades increasingly move from their bent shape toward a planar shape. The blade edges cut a web from both outer edges toward the center, the center portion of the web being cut last. The blades resume their V-shaped configuration when moved to the open position. By limiting the stroke of the moving blade, the center portion of the web being cut remains uncut. The blades have support frames holding one end of the blades fixed while the opposite ends of the blades are permitted to slide to accommodate movement of one end of the blades which are elongated as they flatten. The cutting edges of the blades may be modified to make a complete cut, a partially perforated and partial cut and a perforated cut, across the web. The blades may be driven by a variety of driving devices such as solenoids, motor driven cams and permanent magnets.

17 Claims, 7 Drawing Sheets

CUTTER HAVING A PAIR OF COOPERATING FLEXIBLE BLADES PROVIDING A PAIR OF MOVING POINT CUTTING EDGES

FIELD OF THE INVENTION

The present invention relates to cutters and more particularly to cutting devices utilizing a pair of cutting blades, which are provided with cooperating V-shaped cutting edges to provide two cutting points that move from the ends of the cutting blades towards the center thereof as the cutting edges cross over-one another, the cross-over action further providing a self-sharpening function.

BACKGROUND OF THE INVENTION

Cutting devices are extremely helpful and in some cases necessary in a wide variety of applications. For example, paper cutters, and especially automatic paper cutters are found in many if not most hi-tech electronic equipment such as facsimile machines, receipt dispensing machines, for example of the type for providing transaction receipts in cash dispensing systems, and all sorts of general purpose, as well as special purpose printers. One popular category of cutting devices typically employ some version of a guillotine-type cutter enabling the paper sheet to be cut by a cutting edge which cuts as it moves across the sheet as opposed to a straight, linear cutting edge which cuts sheet so that the entire length of the cutting edge substantially simultaneously cuts through the sheet, thereby placing a greater burden upon the blade and necessitating the provision of a greater operating force.

Regardless of which of the two above-mentioned types of cutting techniques are employed, both designs require precise and tight tolerances between the cooperating cutting edges in order to assure a clean cut. The present day cutting devices require frequent adjustment due to the constant operation of the moving parts and/or the wearing of the cooperating cutting edges.

BRIEF DESCRIPTION OF THE INVENTION

The above, as well as other objects of the present invention are obtained through a cutter device which is characterized by comprising a pair of cutting blades each being formed from a relatively thin gauge spring steel material. Each blade is formed from a flat sheet of said spring steel material and is provided with a substantially V-shaped cutting edge. The blades are each bent so as to deviate from a planar shape and to provide a substantially V-shaped bend with the apex of the V being at substantially the center of the blade. Each blade is further provided with a pair of guide projections for slidably engaging an outer surface of the other blade.

The V-shaped bend in the blades defines a pair of major surfaces which comprise an inner concave surface and an outer convex surface. The blades are arranged so that their concave surfaces face one another and the apexes of the V-shaped bends extend away from one another. Both blades have the same shape and the same resiliency and springiness and undergo a substantially equal amount of deflection during cutting. The guide projections of each blade are arranged so that their inner surfaces engage an outer surface of the other blade, urging the ends of the blades towards one another.

In one preferred embodiment, the blades are arranged so that an upper blade is substantially stationary and a lower blade experiences reciprocating motion. This arrangement may also be reversed, if desired. Alternatively both blades may be moved, if desired. In addition, the cutting device may be oriented at any angle, since the orientation does not affect the cutting operation.

In an open position, the lower blade is at the bottom of its reciprocating stroke whereby the cooperating, substantially V-shaped cutting edges define a substantially diamond-shaped opening for insertion of a member to be cut.

Once the sheet or other member to be cut is inserted into the opening, the lower blade is moved upwardly, typically either by a solenoid or by motor drive means, causing the blade edges to crossover one another during cutting and thereafter overlap one another as the cut is made at the point of cross-over. Substantially, simultaneously therewith, the guide projections of each blade slide downwardly along the outer surfaces of the cooperating blade causing the blade edges of each blade to likewise move along the outer surface of the other blade member after performing a cutting operation, causing the blades to be urged from the bent substantially V-shaped configuration toward a flat-shape as the cutting nears completion and the cutting blades reach the end of the cutting stroke.

After a cutting operation is performed, the lower blade is returned to the bottom of its stroke, the "memory" of the blades returning the blades to their V-shaped configuration when displaced from one another.

The blades are arranged within holders which, in one preferred embodiment, secure one end of each blade thereto while allowing the opposite ends to experience sliding motion as the blades cooperatively urge one another from the V-shape toward a flat-shape. This arrangement avoids tensioning and resulting breakage of the blades, as well as guaranteeing a smooth cut.

If desired, the blades may be slidable at both ends.

Adjustable stops may be provided for limiting the cut so as to leave a small portion of the paper sheet or other member uncut, the uncut portion being that portion of the sheet or other member being cut which is aligned with the apex region of the cutting edges. Although the blade edges preferably define a V-shape, other shapes are possible so long as the blade edge slopes diagonally, inwardly and upwardly in moving from the ends of the blades toward the center thereof. It is further possible to provide a perforated cut across the width of the sheet or other member positioned between the blades or to provide a complete cut through a portion of the sheet while the remaining portion of the sheet receives a perforated cut.

Due to the "cross-over" movement experienced by the blades in moving from the open to the closed and back to the open position, the blade edges are constantly self-sharpened.

Since the blade edges are constantly in contact with one another at the point of the cut, the point of the cut moving inwardly from both outer cutting edges of the blades and the bends in the blades, together with their springy nature provide a cutting force which assures a sharp, fine cut without the need for adjustment and especially without the need for any fine adjustment. These characteristics, together with the self-sharpening characteristic provides a cutting device which has a long, useful operating life and one that is substantially free of adjustment, maintenance repair or frequent replacement.

The cutting device may be manually operated or may be operated by magnetic devices such as solenoids or magnets, operated to provide selective attractive/repellent forces, or a motor drive actuator.

OBJECTS OF THE INVENTION

It is therefore an objective of the present invention to provide a cutting device which provides a clean cut even after long, continuous use.

Another object of the present invention is to provide a novel cutting device, which does not require a precise, tight tolerance adjustment when first set-up and which avoids need for constant, regular readjustment and/or realignment.

Still another object of the present invention is to provide a cutting device which, due to its unique design, is self-sharpening.

Another object of the present invention is to provide a cutting device having a pair of cooperating cutting blades and being designed so that no adjustments are needed to align the blades relative to one another.

Still another object of the present invention is provide a novel cutting device capable of fast operation and which is capable of performing quick, clean cutting operations.

Still another object of the present invention is to provide a novel cutting device having a pair of cooperating overlapping cutting blades with cutting edges designed to automatically center items being cut due to a design which cuts from opposing sides toward a center thereof.

Still another object of the present invention is to provide a novel cutting device of the type described and operating means therefor to perform a cutting operation.

Still another object of the present invention is to provide a novel cutting device which is substantially jam-proof.

Still another object of the present invention is to provide an effective cutting device which can be manufactured and assembled at low cost.

Still another object of the present invention is to provide a novel cutting device having the ability to cut strips of very narrow width.

Still another object of the present invention is to provide a novel cutting device which provides precision cuts in thin lightweight sheets without the necessity for positioning, holding or tensioning means for the items being cut.

Still another object of the present invention is to provide a cutting device which, due to its unique design is capable of cutting a wide variety of objects including sheets, webs and tubular members, for example said webs encompassing a wide variety of material such as paper, cardboard, fabric, a variety of different textiles and metal foil, and for example, is capable of cutting paper over a range of between 40 and 250 grams per square meter.

BRIEF DESCRIPTION OF THE FIGURES

The above as well as other objects of the present invention will become apparent when reading the accompanying description and drawings in which.

DETAILED DESCRIPTION OF THE INVENTION AND PREFERRED EMBODIMENTS THEREOF

FIGS. 1*a*, 1*b*, 1*c*, 2*a* and 2*b* show a cutting device 10 designed in accordance with the principles of the present invention and comprised of a pair of cooperating cutting blades 12 and 14 each supported by an associated holder assembly 16 and 18, respectively. Blade 12 is shown in grater detail in FIGS. 4*a*–4*c*. Blade 14 is substantially identical in design and function to blade 12.

Figure 1A:
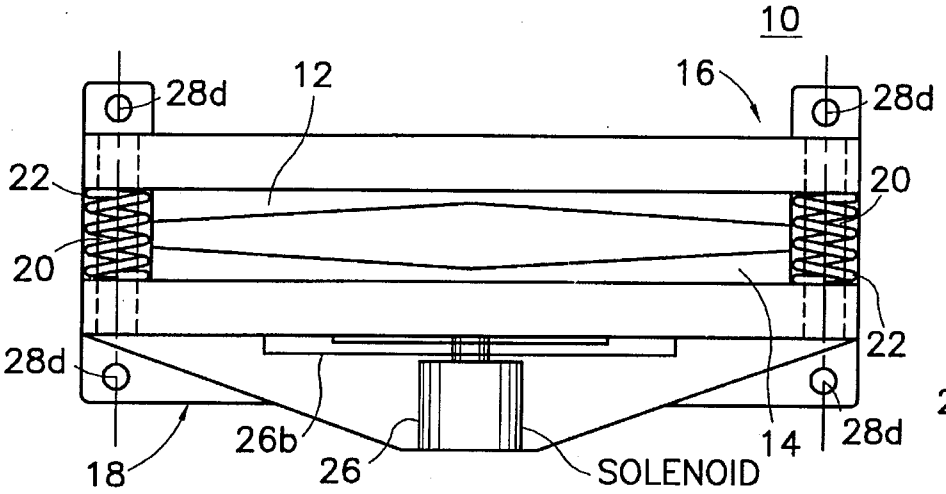
FIG. 1*a* shows a front elevational view of a cutter device designed in accordance with the principles of the present invention.
Figure 1B:
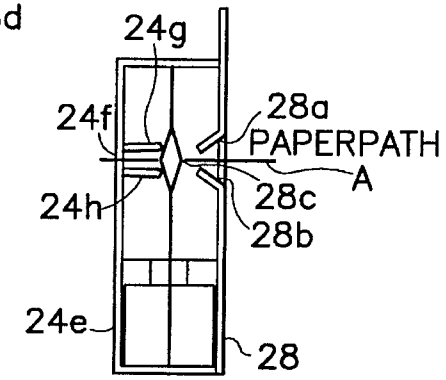
FIG. 1*b* is a side elevational view of the cutting device of FIG. 1*a*.
Figure 1C:
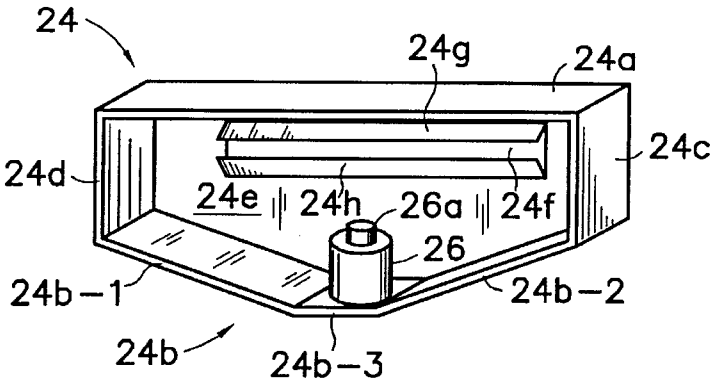
FIG. 1*c* is a perspective view of the cover and solenoid employed in the cutting device of FIGS. 1*a* and 1*b*.

The blade holders 16 and 18 are arranged within a cover 24 and a baseplate 28 (FIG. 1*b*).

Cover 24 has a substantially box-like or parallelepiped shape having an open end defined by top and bottom walls 24*a* and 24*b* and vertical side walls 24*c* and 24*d* (FIG. 1*a*). Vertical wall 24*e* of cover 24 is cut, stamped or otherwise formed to provide an outlet opening 24*f* defined by a pair of integral sheet guide flanges 24*g*, 24*h* arranged on opposite sides of the opening 24*f*. Bottom wall 24*b* is provided with a pair of inclined wall portions 24*b*-1 and 24*b*-2 with an intermediate wall portion 24*b*-3 substantially parallel to side wall 24*a*. Solenoid 26 is mounted upon side wall portion 24*b*-3 and operates in a manner to be more fully described. As an alternative, the solenoid may be replaced with a motor-driven eccentric cam 27 for driving blade 14 (see FIG. 1*e*). Shaft SH, driven by a motor (not shown), is joined to an eccentric opening in cam 27. Alternatively, a handle (not shown) may be used to apply a manually closing force applied to the center of upper holder as shown by arrow X in FIG. 2*a*.

Figure 1D:
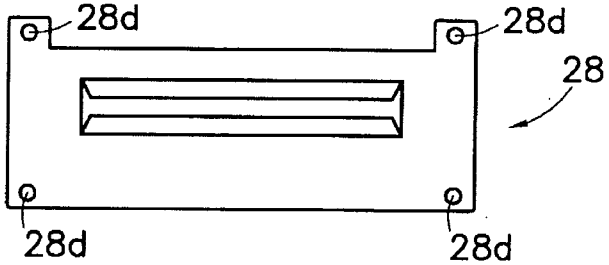
FIG. 1*d* is a perspective view showing the base plate employed in the cutting device of FIGS. 1*a* and 1*b*.
Figure 1E:
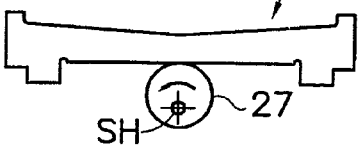
FIG. 1*e* is a simplified elevational view of an alternative arrangement for operating the cutting device.
Figure 1F:
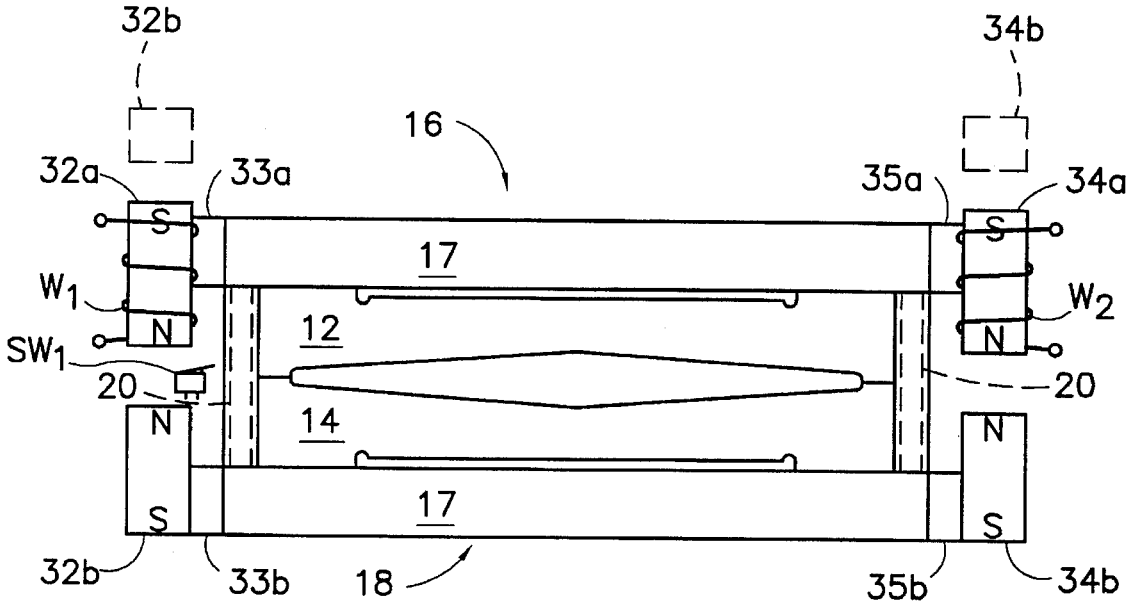
FIGS. 1*f* and 1*g* are elevational and partial elevational views of still other alternative embodiments for operating the cutting device with some parts removed.

FIG. 1*f* shows an alternative embodiment for driving the cutting device which is comprised of a first pair of cooperating permanent magnets 32*a*, 32*b* and a second pair of cooperating permanent magnets 34*a*, 34*b*. Permanent magnets 32*a* and 32*b* are arranged so that their north poles oppose one another in the manner shown. Permanent magnets 34*a* and 34*b* are arranged in a similar fashion. Permanent magnets 32*a*, 34*a* are joined to upper holding assembly 16 by suitable brackets 33*a*, 35*a*. In a similar fashion, permanent magnets 32*b*, 34*b* are mounted to the lower blade holding assembly 18 by brackets 33*b*, 35*b*. A winding W1 in the form of a helical winding surrounds permanent magnet 32*a*. Winding W2, which is a helical winding, surrounds permanent magnet 34*a*.

In operation, windings W1 and W2 are normally deenergized, causing the opposing poles of permanent magnets 32*a*–32*b* and 34*a*–34*b* to maintain the plate holding assemblies 16 and 18 separated, preparatory to a cutting operation.

When a cutting operation is to be performed, windings W1 and W2 are both energized, setting up electro-magnetic fields which counteract the magnetic fields of permanent magnets 32*a*, 34*a*, and further which sets up an equivalent south pole at the lower ends of permanent magnets 32*a*, 34*a* which face the upper ends of permanent magnets 32*b*, 34*b*, causing these magnets to be attracted and thereby drawing the blade holding assemblies 16 and 18 and hence blades 12 and 14 toward one another to perform a cutting operation. It should be understood that the magnetic field strength of the magnetic fields created by current flowing through windings W1 and W2, in addition to being sufficiently large to overcome the permanent magnetic fields created by magnets 32*a* and 34*a* are further sufficient to cause the magnets 32*a*–32*b* and 34*a*–34*b* to be abruptly attracted toward one another to perform a clean cutting operation in a rapid manner.

The currents introduced into windings W1 and W2 are maintained for a period sufficient to draw the blades into the desired cutting position which may be accomplished by suitable timing means or alternatively, a switch SW1 may be provided and having a switcharm SW1A to be engaged by the bracket 33*a* mounted on movable holder member 16, or a suitable arm or projection provided thereon, to close the switch when the cutting devices have moved to the desired position thereby opening a closed conducting path, terminating the cutting operation.

Figure 1G:
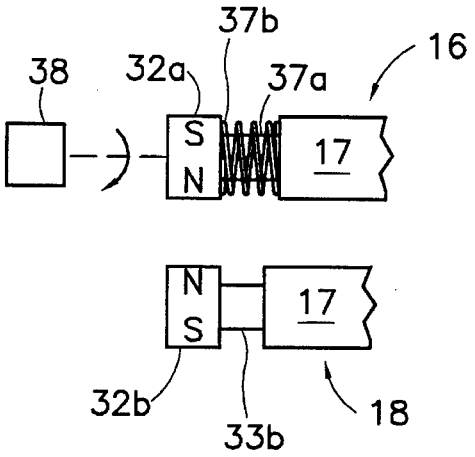

Another alternative arrangement is shown in FIG. 1*g* in which only portions of the upper and lower holding assemblies 16 and 18 have been provided, for purposes of simplicity.

In a manner similar to that shown in FIG. 1*f*, a permanent magnet 32*b* is mounted to the left-hand end of holder assembly 18 by bracket 33*b*. A permanent magnet 32*a* is rotatably mounted to the left-hand end of upper holding assembly 16 by means of a shaft 37*a* having a spring 37*b* mounted thereon. Spring 37*b* is mounted in such a manner as to maintain permanent magnet 32*a* in the position where its north pole opposes the north pole of permanent magnet 32*b* causing the two fields to repel one another and thereby maintain the cutting device in the open position. Drive means 38, for rotating permanent magnet 32*a*, is activated upon initiation of a cutting operation to rotate permanent magnet 32*a* through a 180° angle to place the south pole of permanent magnet 32*a* opposite the north pole of permanent magnet 32*b* and thereby cause the two magnets to be attracted to one another and draw the upper and lower assemblies 16 and 18 and hence blades 12 and 14 toward the cutting position.

Although not shown for purposes of simplicity, it should be understood that a similar pair of permanent magnets are arranged on the right-hand ends of blade holding assemblies 16 and 18, a permanent magnet being rotatably coupled to the right hand end of blade holding assembly 16 and rotatably mounted in the same manner as permanent magnet 32*a* shown in FIG. 1*g*. In a similar fashion, a second drive means operated in parallel with drive means 38 rotates the permanent magnet at the right-hand end of the device simultaneously with rotation of the permanent magnet 32*a* shown in FIG. 1*g* causing both ends of the upper holding assembly to be attracted downwardly (or alternatively causing the lower holder assembly 18 to be attracted upwardly).

When the cutting operation is completed, the drive means (see drive means 38) for rotating the permanent magnets are turned off or otherwise decoupled from the rotatable permanent magnets whereupon the spring members return the permanent magnets to the initial position with the permanent magnet fields of the cooperating magnet pairs repelling one another.

If desired, the rotatable permanent magnets mounted at the upper right and upper left ends of upper holder assembly 16 may be mounted upon a common shaft extending across holder assemblies 16. As a further alternative, the biasing springs (see biasing spring 37*b*) may be eliminated and the drive means 38 may function to rotate in a forward and a reverse direction to move and rotate the upper permanent magnets between their repelling and attractive positions relative to their cooperating, stationary, permanent magnets.

Whereas FIGS. 1*f* and 1*g* show the cooperating, permanent magnets as being respectively, coupled to the upper and lower blade holding assemblies, it should be noted that other alternative arrangements may be utilized. For example, assuming the upper holder assembly is the movable holder assembly, the permanent magnets 32*b*, 34*b* mounted to the lower blade holder assembly may be placed in positions shown in dotted line fashion immediately above the top end of the permanent magnets 32*a*, 34*a* and fixed to a suitable stationary member or bracket of the cutting device or a frame holding and supporting the cutting device, upper blade holder assembly 16 being reciprocated by the change in magnetic field orientations. The fields of magnets 32*a*–32*b* and 34*a*–34*b* may normally be arranged to attract and W1 and W2 activated to cause them to repel to initiate a cutting operation.

The embodiment shown in FIG. 1*g* may be modified in a similar manner by placing permanent magnets 32*b*, 34*b* in positions above magnets 32*a*, 34*a*.

As further alternatives, in the respective embodiments of FIGS. 1*f* and 1*g*, the windings W1 and W2 may be placed about permanent magnets 32*b*, 34*b* and the lower magnet(s) of FIG. 1*g* may be made rotatable while the upper magnet is fixed against rotation relative to its holder assembly. As another alternative, the pairs of cooperating magnets arranged on opposite ends of the holders may be replaced by a single pair of cooperating magnets each respectively coupled to one of the upper and lower holders near the centers thereof. Regardless of which of the alternative embodiments describe herein are utilized, it is preferable that the holder assembly upon which the permanent magnets having windings W1 and W2 mounted thereon be the stationary holder assembly. Similarly, it is preferred that the holder assembly having the rotatably mounted permanent magnets be the holder assembly which is maintained stationary throughout cutting operations.

Front cover 28, also shown in FIG. 1*d*, cooperates with cover 24 to enclose the blades, holders and solenoid within the housing defined by cover 24 and base plate 28, which is further provided with integral, diagonally aligned guide flanges 28*a* and 28*b* whose free ends terminate to define the inlet opening 28*c* which opening is aligned with the opening defined by blades 12 and 14 (to be more fully described) and the outlet opening 24*f*, to provide a straight, linear path for a sheet or web (or tube) as shown by the arrow A. Base plate 28 is further provided with mounting openings 28*d* adapted to receive suitable fastening means (not shown) for securing the base plate 28, and hence the entire assembly, to the outfeed end of a printer advancing mechanism (not shown), for example.

Since the blades 12 and 14 are substantially identical in design and function, a description of only one of the blades will be provided herein for purposes of simplicity.

Figure 2A:
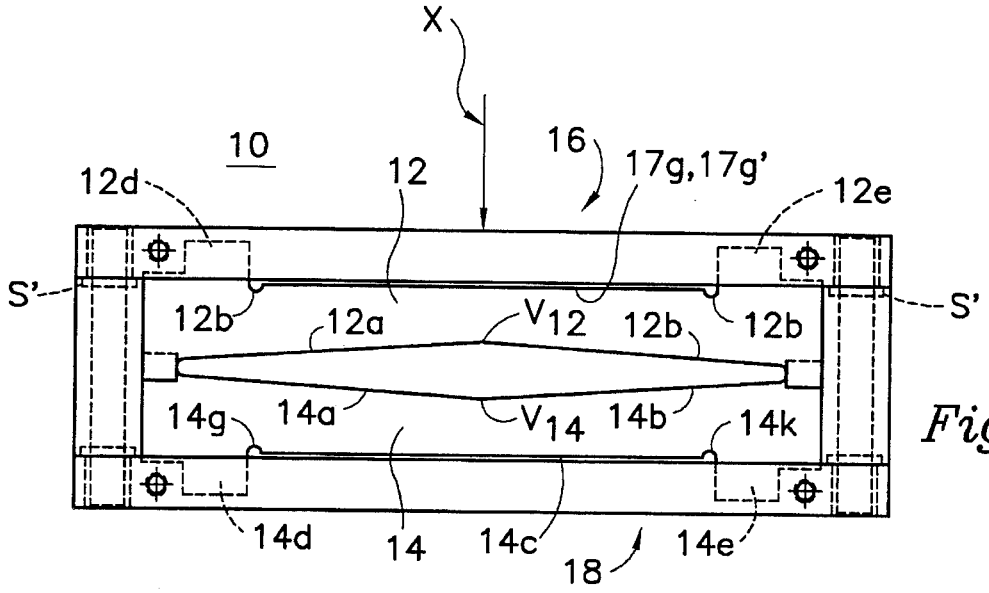
FIG. 2*a* shows the front elevational view of the cutting device of the present invention similar to that shown in FIG. 1*a* and with some of the parts removed.
Figure 4A:
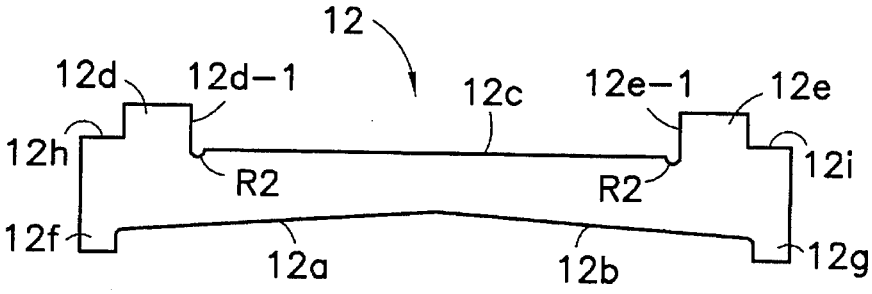
FIGS. 4*a*, 4*b* and 4*c* show side, end and bottom views respectively of one of the blades employed in the cutting device of FIGS. 1*a* and 1*b*.
Figure 4B:
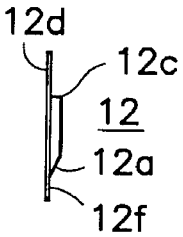
Figure 4C:
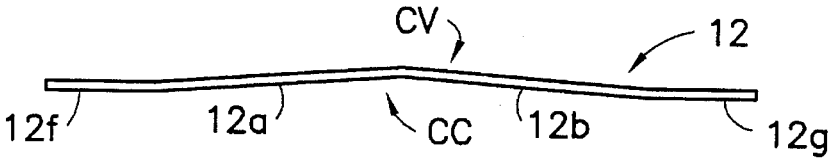
Figure 4D:
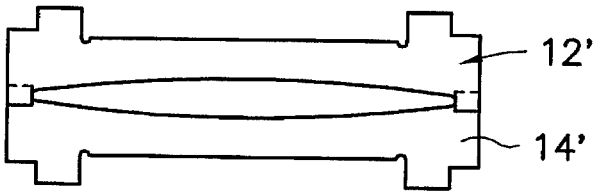
FIG. 4*d* is a plane view showing another cutting edge arrangement.

FIGS. 4*a* through 4*c* show one embodiment of blade 12 which is provided with a substantially V-shaped cutting edge defined by substantially linear cutting edge portions 12*a* and 12*b*. If desired, the blades may alternatively each have curved cutting edges which cooperate to define an ovoid shape as shown in FIG. 4*d*. The rear edge 12*c* opposite blade edges 12*a* and 12*b* spans between a pair of mounting portions 12*d* and 12*e* which are received in suitable holding slots within the holder 16, as will be more fully described. A pair of guide portions 12*f* and 12*g* extend downwardly and away from blade edges 12*a* and 12*b*, and toward associated guide portions of the cooperating blade 14 (FIG. 2*a*).

Blade 12 has a substantially V-shaped bend over the region between the left-hand and right-hand ends of blade 12 (FIG. 4*c*) The blades may alternatively have a smoothly curved configuration in place of the abrupt bends as shown in FIG. 4*c*.

Holders 16 and 18 are substantially identical to one another, and only one of the holder assemblies will be described herein for purposes of simplicity.

Figure 3A:
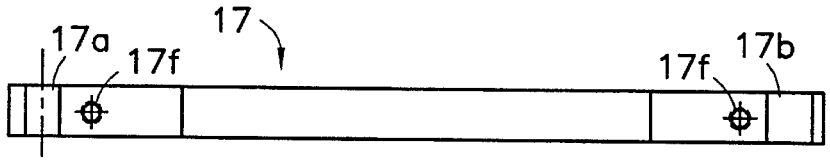
FIGS. 3*a*, 3*b* and 3*c* respectively show side, top and end views of one of the blade holder members employed in the assembly of FIGS. 1*a* and 1*b*.
Figure 3C:
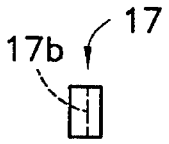
Figure 3B:
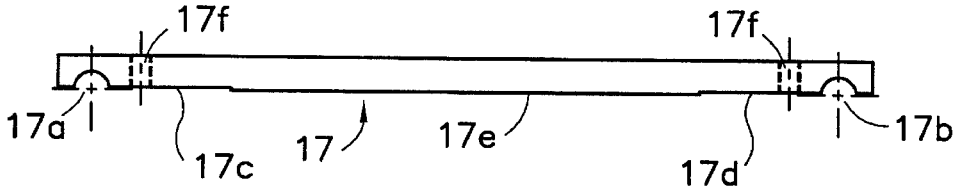

The holder 16 is comprised of a pair of holder halves, one holder half 17 being shown in FIGS. 3*a* through 3*c* as being comprised of an elongated, parallelepiped-shaped bar having a length substantially greater than the length of blade 12, and provided with two semi-circular-shaped grooves 17*a* and 17*b* for receiving one of the guide pins 20 shown in FIGS. 1*a*, 2*a* and 4, as will be more fully described hereinbelow.

Holder half 17 is further provided with a pair of recesses 17*c* and 17*d* which are substantially parallel to surface 17*e*, recess 17*d* being approximately double the depth inward from surface 17*e* extending between the recesses than recess 17*c*. A pair of threaded openings 17*f*, 17*f* are provided near the outer ends of the flat recesses 17*c* and 17*d* for receiving threaded fastening members (not shown) for securing two holder halves 17, 17' together and thereby clamping blade member 12 therebetween (see FIGS. 2*a* and 2*b*).

Figure 2B:
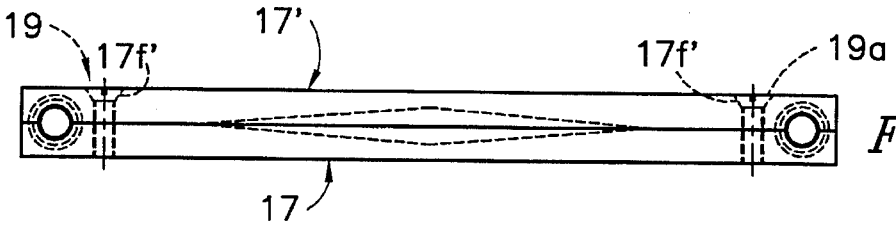
FIG. 2*b* shows a top view of the cutting device of FIG. 2*a*.

FIG. 2*b* shows the manner in which a pair of holders 17 and 17' are joined together. Holders 17 and 17' differ from one another only in that holder 17 is provided with threaded openings 17*f*, 17*f* whereas holder 17' is provided with a partially tapered opening 17*f'*, 17*f'* each for receiving the tapered head 19*a* of a threaded member 19.

The deeper recess 17*c*, in one preferred embodiment, is 0.15 millimeters while the shallower recess 17*d* is 0.10 millimeters. With the recesses 17*d*, 17*d'* aligned, the width of the slot receiving the holder portion 12*d* is 0.20 millimeters. The blade, in one preferred embodiment, has a thickness of the order of 0.25 millimeters thus being firmly clamped within the slot formed by recesses 17*d*, 17*d'*.

The recesses 17*c*, 17*c'* form a slot having a width of 0.30 millimeters, which is greater than the thickness of the blade 12 and the holder portion 12*d* thereby causes one end of the blade to be clamped while the other end of the blade is permitted to slide, which feature will be fully described hereinbelow in conjunction with the description of a cutting operation.

Rear edge portions 12*h* and 12*i* of blade 12 extend outwardly and to the rear a greater distance than rear edge 12*c*. Rear edges 12*h* and 12*i* each engage an associated one of the fasteners 19 to limit the inward extent to which blade 12 extends into the holder slots. When edges 12*h* and 12*i* each abut an associated fastener 19, edge 12*c* is clear of the inward sides 17*g*, 17*g'* of the holder halves 17, 17' enabling the intermediate portion of blade 12 to freely flex, as will be more fully described.

The blade 14 and its holders are substantially identical to blade 12 and its holders and hence blade 14 can be seen to have its holder portions 14*d* and 14*e* extending into cooperating slots of the holder halves of holder 18 while rear edge 14*c* is spaced inwardly from the upper edges of the holder halves which comprise holder assembly 18 (see FIG. 2*a*).

Figure 5:
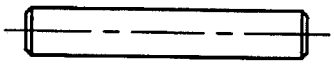
FIG. 5 shows one of the supporting shafts employed in the assembly of FIGS. 1*a* and 1*b*.

The half circular openings 17*a*, 17*b* and 17*a'*, 17*b'* each cooperatively form a circular opening for slidably receiving a guide pin 20, 20, the guide pin 20 being shown in greater detail in FIG. 5. A helical spring 22, 22 is wound about each guide pin 20, 20 and normally biases the holders 16 and 18, and hence the blades 12 and 14, to the open position.

Blade 14 has a pair of blade edges 14*a*, 14*b*, which cooperate with blade edges 12*a*, 12*b* to form a substantially, diamond-shaped opening as shown, for example, in FIG. 2*a*. The blades are arranged within the cutting assembly so that the bent portions, which form a concave surface CC and a convex surface CV, are aligned so that the concave surfaces CC of blades 12 and 14 face one another and so that the convex surfaces CV are on the outer sides of the assembly as shown, for example, in FIGS. 6*a*–6*c*, when in the rest position. The guide portions 12*f*, 12*g* of blade 12 are arranged to lie against the convex surface CV of blade 14. Similarly, the guide portions 14*d*, 14*e* are arranged between the holder halves of holder assembly 18 with the right-hand clamping portion being clamped against movement while the left-hand clamping portion 14*d* is permitted to experience sliding movement. The guide portions 14*f*, 14*g* lie against the convex surface CV of blade 12.

Each of the blades is further provided with semi-circular slots 12*j*, 12*k* and 14*j*, 14*k* for facilitating bending of their respective blades while preventing fracturing due to such constant bending.

The operation of the cutting device 10 is as follows:

Initially, solenoid 26 is de-energized causing its armature 26*a* to be urged downwardly due to the force of springs 22, placing blades 12 and 14 in the open position, as shown, for example, in FIGS. 1*a* and 2*a*.

Figure 6B:
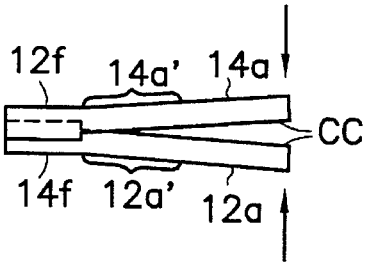
FIG. 6*a*, 6*b* and 6*c* show detailed, enlarged, sectional views of an engaging portion between said blades which are useful in explaining the operation of the present invention.
Figure 6C:
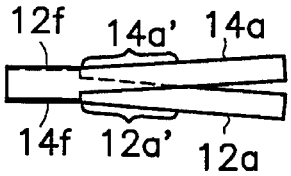
Figure 6A:
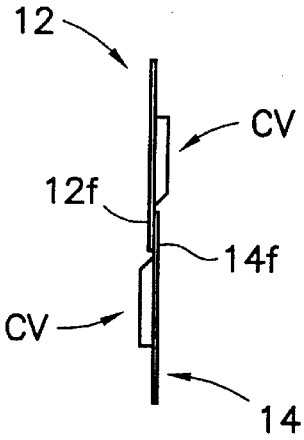

The guide portions 12*f* and 14*f* of blades 12 and 14, as shown, for example, in FIG. 6*a*, being in sliding engagement with the convex surfaces CV of the opposing blade 14 and 12, respectively urge the outer ends of blade edges 12*a*, 14*a* to likewise cross over to the convex surfaces CV of the opposing blades 14 and 12, respectively, as shown in both FIGS. 6*a* and 6*b*. Energizing of solenoid 26 causes the crossover points to move toward the center of the blades. FIG. 6*c* shows a view similar to that shown in FIG. 4*b* wherein portions of the cutting edges 12*a*', 14*a*' have moved from the concave surfaces of the opposing blades 14 and 12 (see FIG. 6*c*) to the convex surfaces, as shown, also in FIG. 6*c*. This crossover movement continues until the blades have the vertices V12 and V14 of the blades with the V-shaped cutting edges overlapping at which time the cut is complete.

The "criss-crossing" or "crossing-over" of the blades in this manner cause the bent portions thereof to be deflected from their bent V-shape toward a flat, planar condition. As a result, the distance between the extreme ends of each blade increases due to the lengthening of the blades. For example, in one preferred embodiment, the ends of the blades, in their open, deflected (i.e. V-shaped) state, with solenoid 26 deenergized, are separated by a distance of 98 millimeters. When the blades are moved from the open position to the fully closed position, completing the cutting operation, the blades elongate to a length of the order of 100 millimeters. This lengthening is fully accommodated by the clamping grooves described hereinabove wherein the clamping projections 12*e*, 14*e* are firmly clamped to prevent any movement relative to their associated holders while the clamping projections 12*d*, 14*d* are slidable within the clamping recesses 17*c*, 17*c*' to accommodate elongation of the blades as they are biased from their deflected position shown in FIG. 4*c* to a substantially flat position. The blades may both be clamped at either their right-hand ends or at their left-hand ends. Alternatively, the blades may be free to slide at both ends, by providing slots of a width of 0.30 millimeters, for example, for slidably guiding blade portions 12*d*, 12*e* and 14*d*, 14*e*. As still another alternative both blades may be fixed at one end and slidable at the opposite end wherein the fixed ends are remote (i.e. diagonally opposite) from one another. As still another alternative both ends of one blade may be fixed and either one or both ends of the other blade may be slidable.

Movement to the closed position is accomplished by energizing solenoid 26 causing the blade holders and hence the blades to move to the closed position. When the solenoid armature 26*a* is at the end of its closing stroke, the solenoid is de-energized causing the blade holders and hence the blades to return to the fully open position under the force of helical springs 22, 22. The "memory" of the blades 12, 14 cause the blades to return to the undeflected or V-shaped configuration.

Blades 12, 14 interact with one another to provide a resilient loading each upon the other. This arrangement also eliminates the need to provide a separate, independent device for exerting a force on each blade toward the other.

Elongated distributor member 26*b* is coupled to the free end of solenoid armature 26*a* and assures even distribution of the force applied through holder 18 to the blade 14 by solenoid 26 even in the event that the centerline of the solenoid armature is offset relative to the center of blade 14.

The cutting device may accommodate items to be cut such as, for example, paper sheets, of any width up to the maximum width of the diamond-shaped opening. Sheets of greater width may be accommodated by providing blades of a greater width.

In applications where it is desired to cut an item such as a paper sheet partially so as to leave a small portion thereof uncut, for example, to prevent a dispensed ticket from falling from a dispenser to the floor, spacers S, S' may be provided on the guide pins 20, 20 to prevent the holders and hence the blades from overlapping in the region of the vertices V12 and V14.

The cutting device 10 provides precise and positive cutting for paper sheets of even very thin gauge, as well as paper of heavy gauge. For example, the cutter can accommodate sheets in the range of 40 to 250 grams per square meter. The paper cutter is capable of cleanly and accurately cutting sheets of extremely narrow width. Other materials, for example, plastic or soft metals, can also be cut in a like manner.

Figure 2C:
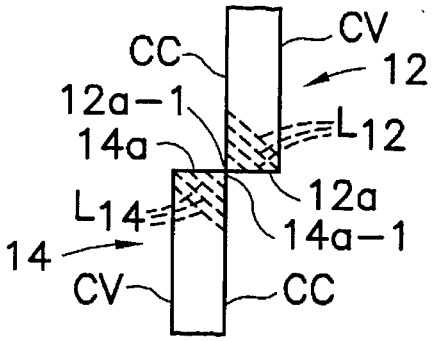
FIGS. 2*c* through 2*e* show enlarged sectional views of the blade edges of a pair of cooperating blades and which are useful in explaining the self-sharpening characteristics of the present invention.
Figure 2D:
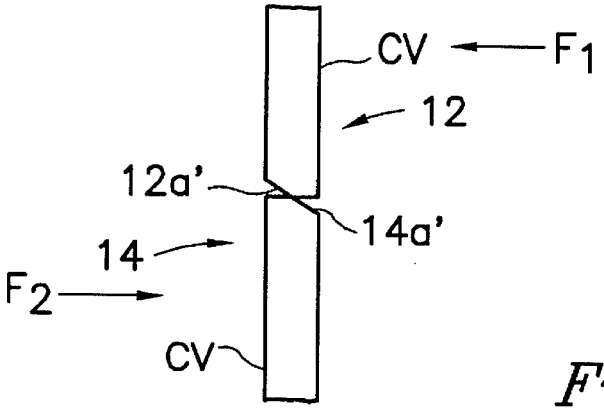
Figure 2E:
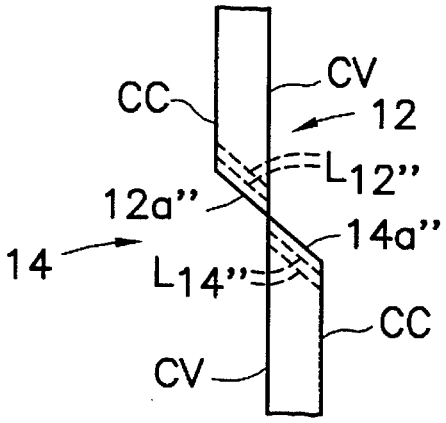

The constant crossing over of the blade edges provides a unique self-sharpening feature. FIGS. 2*c* through 2*e* show cross-sectional views of blade edge portions 12*a* and 14*a* of blades 12 and 14 immediately after they have cut the web. The thicknesses of the blades in FIGS. 2*c*–2*e* have been exaggerated for purposes of simplifying an understanding of the blade sharpening feature. Incidentally, this is also true of FIGS. 4*b*, 4*c*, 6*a*–6*c*, 7*b* and 8*b*.

As the blades cross over, cutting occurs between the lower left-hand edge 12*a*-1 of blade 12 and the upper right-hand edge 14*a*-1 of blade edge 14*a*. The cutting operations over a period of time causes wearing of the blades forming a diagonally aligned surface which gradually enlarges in surface area as represented by the lines $L_{12}$ and $L_{14}$ in FIG. 2*c*.

FIG. 2*d* shows an early stage of blade wearing wherein diagonally aligned surfaces 14*a*' and 12*a*' have been formed. The wearing continues in this fashion until diagonal surfaces 12*a*" and 14*a*" are formed in blades 12 and 14, which diagonal surfaces extend from the convex (CV) surface to the concave (CC) surface of the blades.

Ultimately, wearing of the blades will occur as represented by the line $L_{12}'$ and $L_{14}'$ in FIG. 2*e* in which the height of the blade is reduced, thereby enlarging the diamond-shaped opening formed by the blades. Compensation for the enlargement of the opening can be accommodated by increasing the length of the stroke of the solenoid which is quite small since an extremely long operating period is required before the blades wear to the extent shown in FIG. 2*e*.

The thickness of the blades is so small that forces $F_1$ and $F_2$ moving the blades from the position shown in FIG. 2*c* to the position shown in FIG. 2*d*, are not noticeably diminished as the blades wear.

Although no blade edge preparation is necessary to achieve precision cutting, in an alternative embodiment, blade edges can be ground or an edge preparation can be accomplished by a stamping or cutting technique, for example. The edge is ground or otherwise formed to provide the same taper shown by the diagonally aligned edges in FIG. 2*e*. Nevertheless, the cutting device is inexpensive to produce and assemble while providing effective and reliable operation.

The cutting device of the present invention, although advantageously adapted for use as a paper cutter for application in systems including ticket printers, for example, is also capable of being used in a wide variety of cutting applications for cutting flat, round, oblong and other shapes as well as other materials, such as, cardboard, cloth, plastic (both sheets and tubing) and the like. Blade thickness may be increased to cut materials other than paper.

FIGS. 7*a*, 7*b* and 8*a*, 8*b* show other blade configurations which may be employed to obtain perforated cutting patterns.

Figure 7A:
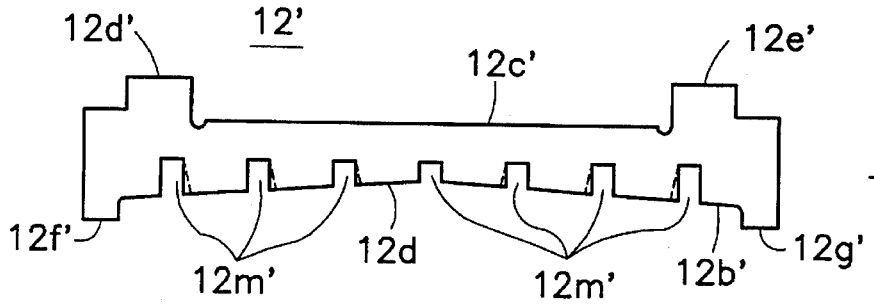
FIGS. 7*a* and 7*b* show side and bottom views of an alternative blade design intended to perforate the material rather than to cut and completely separate.
Figure 7B:
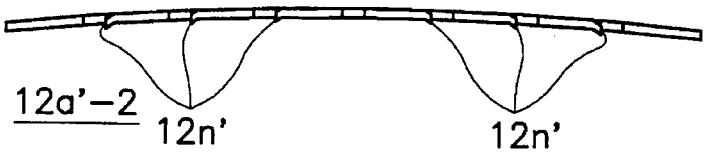
Figure 7C:
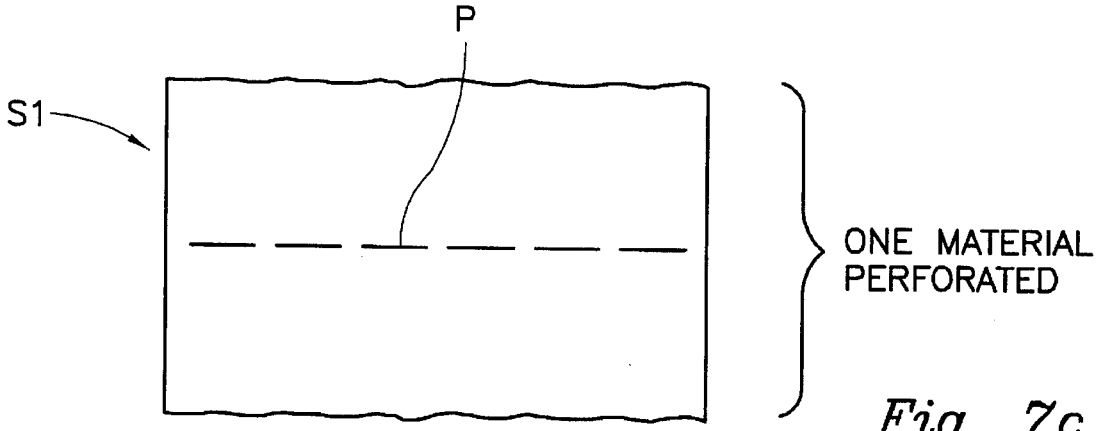
FIGS. 7*c* and 7*d* are views showing the cutting pattern formed by the blade of FIG. 7*a* and 7*b* and demonstrate the cutting of two separate material strips.
Figure 7D:
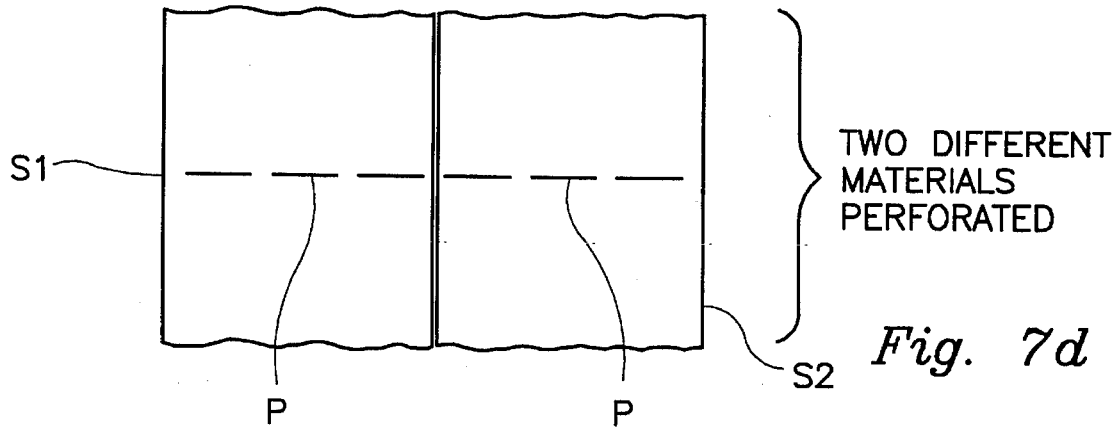

FIGS. 7*a* and 7*b* show a blade 12', which is substantially identical in every respect to blade 12 except for the cutting edge wherein cutting edge portions 12*a*' and 12*b*' are each provided with slots 12*m*'. One marginal edge portion adjacent each slot 12*m*' is bent in a manner shown best in FIG. 7*b* to facilitate smooth crossing over of the cooperating blades. FIG. 7*c* shows the manner in which a single sheet S1 is cut to form a perforated pattern P using a pair of blades of the type shown in FIGS. 7*a* and 7*b*. As an alternative, as shown in FIG. 7*d*, two sheets S1 and S2 may be fed side-by-side with each being cut by blades of the type shown in FIG. 7*a* to provide a perforated pattern P.

Figure 8A:
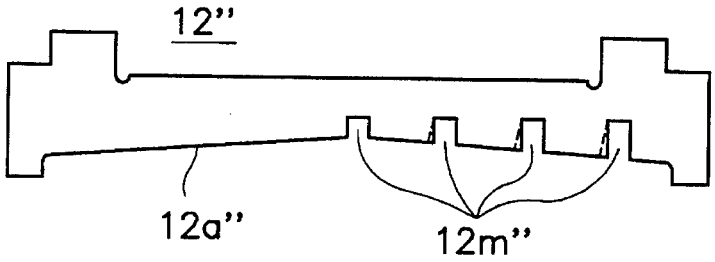
FIGS. 8*a* and 8*b* show side and bottom views of another alternative blade design, where one strip is fully cut and the other only perforated.
Figure 8B:
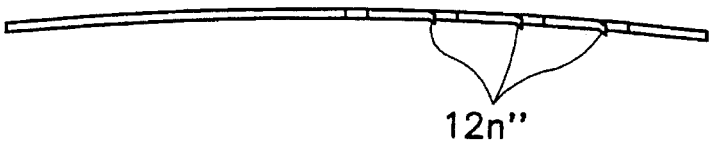

FIGS. 8*a* and 8*b* show another alternative blade design wherein blade 12" is designed so that the left-hand half of the blade is identical to the left-hand of blade 12 shown, for example, in FIG. 4*a* whereas the right-hand half of blade 12' is provided with slots 12*m*' and bent over portions 12*n*' as shown best in FIG. 8*b*. FIG. 8*c* shows the manner in which a single sheet S1 is cut when employing blades of the type shown in FIG. 8*a*, wherein a continuous cut C is provided at the left-hand portion of the sheet S1 and a perforated pattern P is provided in the right-hand portion thereof.

Figure 8D:
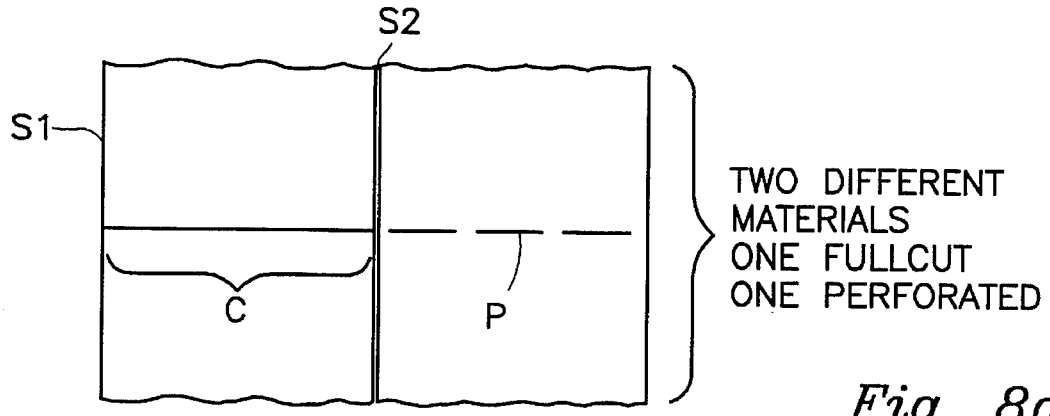
FIGS. 8*c* and 8*d* show cutting patterns formed by the blade of FIGS. 8*a* and 8*b*.
Figure 8C:
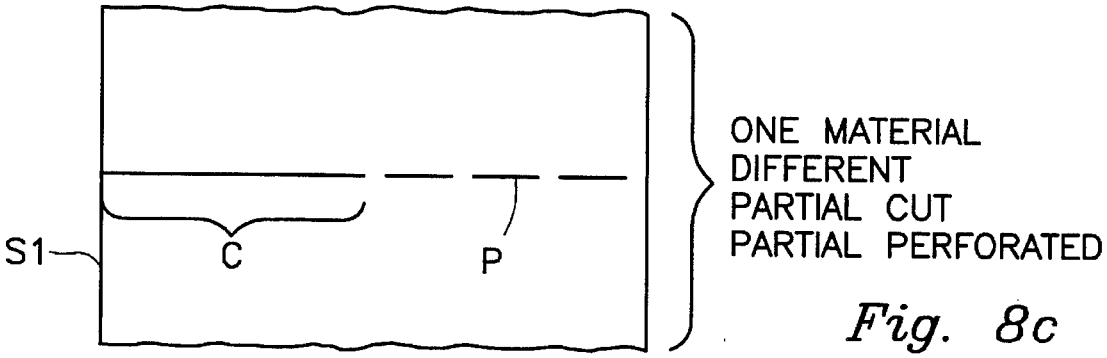

FIG. 8*d* shows sheets S1 and S2 fed through a cutting device employing blades of the type shown in FIG. 8*a* wherein sheet S1 is severed into two independent parts as shown by cut C where-as sheet S2 is cut with a perforated pattern P.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What I claim is:

1. A cutting device, comprising:

first and second cutting blades, each formed of a thin, resilient, springy, metallic sheet;

each blade having a substantially, V-shaped cutting edge;

said blades being positioned to slidingly engage one another so that said cutting edges, in an open position, define a substantially diamond-shaped opening, said diamond-shaped opening gradually reducing in size as the blades move toward a closed position;

each blade having a curved configuration defining a concave major surface and a convex major surface, said blades being arranged so that the major concave surfaces face one another;

opposing ends of said blades each having integral guide projections each slidingly engaging the convex major surface of an adjacent blade whereby movement of said blades toward said closed position causes the cutting edges of each blade to cross-over one another to perform cutting and to thereafter slidingly engage the convex major surface of the adjacent blade, causing the blades to gradually assume a flat condition as the blades move toward said closed position; and said blades resuming a curved contour as the blades move toward the open position.

2. The cutting device of claim 1 wherein each blade is provided with holding portions extending outwardly from a rear edge of each blade;

holding means for each blade including means for securing one of said holding portions against movement and second means for slidably receiving a remaining one of said holding portions, enabling movement of said remaining one of said holding portions relative to said holding means as the blades are moved to the closed position due to elongation of the blades and as they are thereafter moved toward the open position.

3. The cutting device of claim 2 further comprising:

each blade having a rear edge portion spanning between said holding portions, said holding means holding said rear edge portion at a spaced distance from said holding means to enable free bending movement of each blade as it moves between the open and closed positions.

4. The cutting device of claim 2 wherein means for securing said holding means against movement are arranged diagonally opposite one another.

5. The cutting device of claim 1, wherein said curved blades are bent to define a substantially V-shaped configuration.

6. The cutting device of claim 5, wherein an apex of the V-shaped configuration is arranged in an intermediate portion of each blade, said apices being spaced apart a given distance when said blades are in said open position;

a separation distance between said blades gradually decreasing on both sides of said apices toward outer ends of the blades as the blades are moved to the closed position.

7. The cutting device of claim 6, wherein said apices move toward one another as said blades move toward the closed position and wherein said apices move apart from one another as said blades are moved toward the open position.

8. The cutting device of claim 7, further comprising guide means; and holder means for guiding said blades being provided with means for slidably receiving said guide means to guide said holder means along a predetermined linear path.

9. The cutting device of claim 8, wherein said guide means comprises guide pins.

10. The cutting device of claim 9, further comprising bias means for normally biasing said holder means apart to urge said cutting blades toward the open position.

11. The cutting device of claim 10, wherein said bias means comprise helical springs;

said guide pins each extending through a hollow center of an associated one of said helical springs.

12. The cutting device of claim 11, further comprising limit means for limiting movement of said holder means to halt movement of the cutting edges of said Cutting blades a predetermined distance from a fully closed position to prevent an intermediate portion of an item inserted into the opening defined by said cutting blades from being cut.

13. The cutting device of claim 12, wherein said limit means comprises means slidably mounted on said guide pins and engaged by the holder means to prevent the cutting edges of said cutting blades in an intermediate region of said blades from cutting said intermediate portion of the item inserted therethrough aligned with the intermediate region of said cutting blades.

14. The cutting device of claim 1 wherein each blade is provided with holding portions extending outwardly from a rear edge of each blade;

holding means for each blade including means for slidably receiving said holding portions, enabling movement of said holding portions relative to one another as the blades are moved to the closed position due to elongation of the blades and as they are thereafter moved toward the open position.

15. The cutting device of claim 1 wherein each blade is provided with holding portions extending outwardly from a rear edge of each blade;

first holding means for one of said blades including means for securing said holding portions of said one blade against movement and second holding means for another one of said blades including first means for fixedly securing one of said holding portions of said another one of Said blades against movement and second means for slidably receiving a remaining one of said holding portions of said another one of said blades, enabling movement of the holding portion which is slidably received as the blades are moved to the closed position due to elongation of the blades and as they are thereafter moved toward the open position.

16. The cutting device of claim 1 wherein each blade is provided with holding portions extending outwardly from a rear edge of each blade;

holding means for each blade including means for slidably receiving said holding portions, enabling movement of said holding portions relative to said holding means as the blades are moved to the closed position due to elongation of the blades and as they are thereafter moved toward the open position.

17. A cutting device, comprising:

first and second cutting blades, each formed of a thin, resilient, springy, metallic sheet;

each blade having a substantially, curved cutting edge;

said blades being positioned to slidingly engage one another so that said cutting edges, in an open position, define a substantially ovoid-shaped opening, said ovoid-shaped opening gradually reducing in size as the blades move toward a closed position;

each blade being bent to provide a V-shaped configuration substantially defining a concave major surface and a convex major surface, said blades being arranged so that the major concave surfaces face one another;

opposing ends of each of said blades having integral guide projections each slidingly engaging the convex major surface of an adjacent blade whereby movement of said blades toward said closed position causes the cutting edges of each blade to cross-over one another to perform cutting and to thereafter slidingly engage the convex major surface of the adjacent blade, causing the blades to gradually assume a flat condition as the blades move toward said closed position; and said blades resuming a curved contour as the blades move toward the open position.

* * * * *